United States Patent [19]

Seidl et al.

[11] 4,019,310

[45] Apr. 26, 1977

[54] APPARATUS FOR DIGITALLY MONITORING OPERATING PARAMETERS OF AN OPEN-END SPINNING MACHINE

[75] Inventors: Pavel Seidl; Josef Rod, both of Usti nad Orlici; Jiří Deutsch, Vrchlabi; Josef Bartoš, Usti nad Orlici, all of Czechoslovakia

[73] Assignee: Elitex, koncern textilniho strojirenstvi, Liberec, Czechoslovakia

[22] Filed: Apr. 12, 1976

[21] Appl. No.: 675,947

[30] Foreign Application Priority Data

Apr. 15, 1975 Czechoslovakia ..... 2581/75

[52] U.S. Cl. ..... 57/34 R; 57/58.89

[51] Int. Cl.[2] ..... D01H 13/32; D01H 1/12

[58] Field of Search ..... 57/34 R, 58.89–58.95, 57/81; 235/92 R

[56] References Cited

UNITED STATES PATENTS

| | | | |
|---|---|---|---|
| 3,680,298 | 8/1972 | Saunders | 57/34 R |
| 3,680,299 | 8/1972 | Lee, Jr. | 57/34 R |
| 3,877,209 | 4/1975 | Seidl et al. | 57/58.89 X |
| 3,877,210 | 4/1975 | Seidl | 57/34 R |
| 3,878,671 | 4/1975 | Seidl et al. | 57/34 R |

*Primary Examiner*—John Petrakes

[57] ABSTRACT

A plurality of portions of an open-end spinning machine are dynamically coupled to a plurality of magnetic discs for generating a plurality of pulse sequences indicative of the operating speed of the spinning unit portions, i.e., sliver supply speed, yarn withdrawal speed, etc. The so-generated sequences of pulses are routed through a cyclically operated multi-tap switch into a main and an auxiliary binary counter. The output states of the various counters are out-pulsed to a memory and to a data transmission line after being filled during each switching interval of the multi-tap switch, such interval normally being set by a clock pulse generator. In order to generate ratios of the measured quantities, i.e., the machine draft, the clock pulse generator is overridden and the auxiliary counter initially measures a quantity (i.e., the sliver input rate) indicative of the divisor of the ratio. The auxiliary counter output state representative of such divisor is temporarily stored and outpulsed to the enabling input of the auxiliary counter during the time that the multi-tap switch outpulses, to the main input of such counter, a pulse sequence indicative of the dividend of the ratio (i.e., the yarn withdrawal rate). The resulting count on the auxiliary counter is, like the count of the main counter, outpulsed to the memory and/or the data transmission line.

10 Claims, 4 Drawing Figures

APPARATUS FOR DIGITALLY MONITORING OPERATING PARAMETERS OF AN OPEN-END SPINNING MACHINE

BACKGROUND OF THE INVENTION

The invention relates to apparatus for monitoring the performance of open-end spinning machines, and more particularly to such types of monitoring apparatus having a digital readout.

In modern types of open-end spinning machines operating at automatically-controllable high speeds, efficient machine performance is often dependent on corrections made at several operating points of the machine. Such points may include the rotary spinning chamber, the combing-out cylinder which is associated with the spinning chamber for separating slivers into fibers to be spun into yarn by the spinning chamber, and the area of the machine which advances slivers into the working space of the combing cylinder. In addition, in order to ascertain total machine output and/or input-output efficiency, it is necessary to evaluate the rate of withdrawal of the yarn from the spinning chamber to the bobbins on which the yarn is cross-wound. Frequently, it is also desirable to monitor the operation of the distributing rollers, or other portions of the machine that impart twist into the yarn.

In order to monitor these various parameters, it is customary to associate, with the relevant portion of the machine, a portable or semi-portable tachometer of photoelectric probe, which in turn is coupled to circuitry peculiar to the particular measurement being taken. It is customary, particularly when measuring ratios of the measured quantities (e.g., to obtain the machine draft in number of twists per unit length or the ratio between the withdrawal speed of the yarn and the feeding speed of the input sliver to employ special-purpose digital circuitry with the tachometer or probe.

A disadvantage of such known arrangements is the relatively long time delay necessary to adjust the special-purpose equipment involved for the successive measurements of separate parameters of the machine. This is particularly true in those cases where power is removed from the associated portion of the machine prior to measurement, whereby such time delay causes the speed of the monitored part to drop appreciably beyond the point where such monitoring is ideally effective for its intended purpose; such considerations are particularly significant during the measurement, e.g., of the braking efficiency of the spinning chamber and the combing cylinder.

Moreover, because of the special-purpose nature of the equipment necessary to monitor each of the various parameters of the machine in such prior arrangements, the measurements taken (even when converted into digital form) are not suitable for application to a central processor.

SUMMARY OF THE INVENTION

Such disadvantages are overcome with the apparatus in accordance with the invention for digitally monitoring selected operating parameters of an open-end spinning machine of the above type.

In an illustrative embodiment, sensors are permanently associated with the various monitoring points of the machine and are adapted to generate a sequence of pulses at a rate proportional to the operating speed of such portion. The various sensors are coupled to separate inputs of a sequentially-operable, multi-tap switch whose operation is normally accomplished at a regular rate by means of a clock pulse generator. A pair of separate outputs of such switch are individually coupled to a main and an auxiliary binary counter. The main counter is arranged to outpulse frames of digital quantities which represent the instantaneous operating speeds of the successive parameters to be monitored, while the auxiliary counter is operated to generate ratios of the monitored quantities.

A control circuit responsive to a synchronizing pulse generator controls the interleaving of the outputs of the main and auxiliary counters to a common memory and to a data transmission interface unit, whose output is linked to a main central processor. A local display panel mounted on the housing of the spinning machine may also be coupled to the output of the memory.

A feature of the invention is the provision of facilities for overriding the clock pulse generator when the auxiliary counter is employed to produce ratios of the successive measured quantities.

A further feature of the invention is the provision of delay circuitry which responds to the cutout of the power supply relays to certain portions of the machine, i.e., to the spinning chamber and the combing cylinder, for enabling the binary counters at an accurately predetermined time after cutout. With this technique, the efficiency of braking of the spinning chamber and the combing cylinder can be accurately determined.

BRIEF DESCRIPTION OF THE DRAWING

The invention is further set forth in the following detailed description taken in conjunction with the appended drawing, in which.

DETAILED DESCRIPTION

Figure 1:
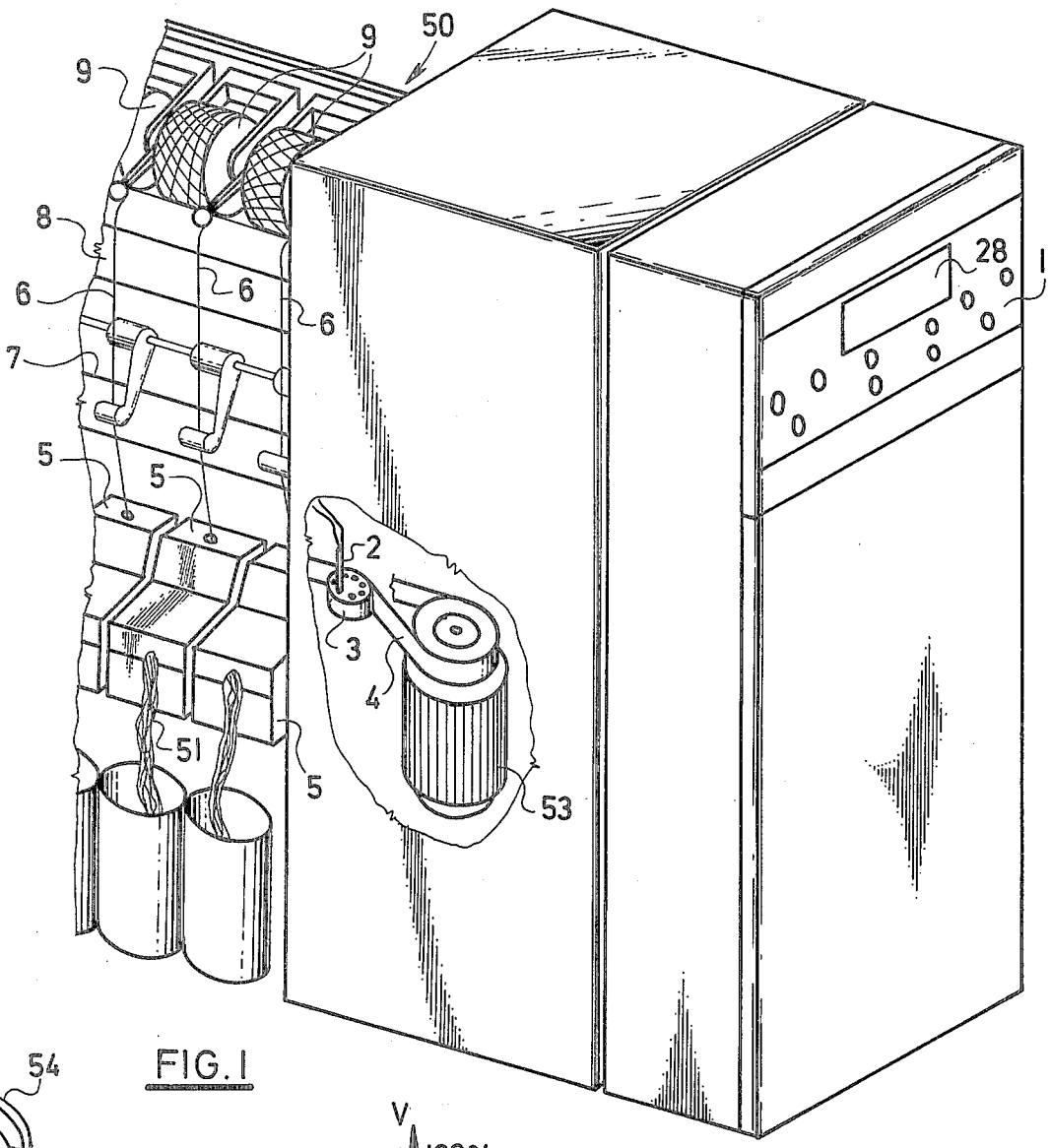
FIG. 1 is a pictorial representation of an open-end spinning machine having monitoring facilities constructed in accordance with the invention.

Referring now to the drawings, FIG. 1 illustrates major components of an open-end spinning machine 50. In a conventional manner, a plurality of slivers 51, 51 are introduced into subassemblies 5, which conventionally include (1) at least one combing out cylinder for separating the associated sliver 51 into fibers, (2) an input section for advancing the slivers into the combing out cylinder, and (3) a spinning chamber which cooperates with the output of the combing out cylinder to receive the separated fibers and to spin such fibers into yarn. Each of these components of the subassembly 5, and their manner of cooperation, are well known to those skilled in the art.

Yarn spun in the spinning chamber of each of the subassemblies 5 is represented at 6, and is withdrawn from the upper portion of the subassembly 5 to plurality of rollers 7, 8 for distributing the yarn in a cross-wound pattern on bobbins 9, 9.

In order to efficiently control the operation of the machine 50 under high-speed conditions, it is desirable ideally to keep track of (1) the rate of feeding of the slivers 51 into the subassemblies 5, (2) the rotational speed of the spinning chamber, (3) the rate of withdrawal of the spun yarn 6 from the subassembly 5, (4) the speed of operation of the members, if any, associated with the subassembly 5 for twisting certain of the separated strands from the combing out cylinder prior to entry into the spinning chamber, and (5) the rotational speed of the combing out cylinder in the subassembly 5. In addition to observing the quantities themselves, the ratios formed by certain of them are also useful, i.e., in the determination of machine draft (i.e., number of twists per unit length) machine efficiency represented by the withdrawal speed of the yarn relative to the input feeding speed of the slivers, and braking efficiency of the various rotational shafts, i.e., the shafts associated with the spinning chamber and the combing out cylinder. In accordance with the invention, an improved type of monitoring apparatus is associated with sensors that detect quantities proportional to the above parameters, and to interleave them sequentially in digital form for outpulsing to a central processor.

Figure 2:
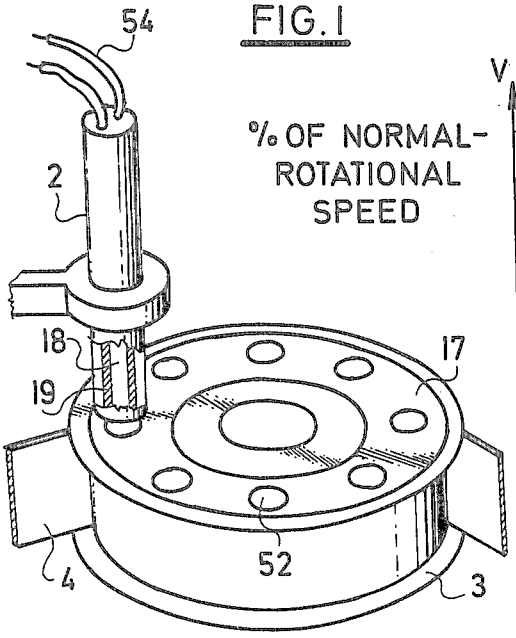
FIG. 2 is a fragmentary perspective view of an electromagnetic probe suitable for use as a sensing element in various portions of the monitoring system of FIG. 1.

A sensor suitable for use for such an arrangement is depicted in FIG. 2. The sensor may take the form of a measuring roller 3 to which is coaxially affixed a disc 17 having a plurality of magnetic indicia 52, 52 distributed circumferentially on its surface. As indicated in FIG. 1, each such roller 3 may be situated in contacting relation with a drive belt 4 which extends between a main drive motor 53 and the drive shaft of the associated portion of the machine (e.g., the combing out cylinder, the spinning chamber, etc.). The rotation of such drive motor 53 will cause the drive belt 4 to proportionally rotate the roller 3, thereby sequentially moving the indicia 52 past an electromagnetic probe 2 which is disposed in magnetically coupled relation to the surface of the marked disc 17. In particular, each probe 2 may be provided with a permanent magnet 18 and an associated winding 19, which generates a pulse on a pair of output leads 54 each time one of the indicia 52 passes the probe 2.

Consequently, the output of the illustrated sensor will be a sequence of pulses at a rate proportional to the actual instantaneous rate of operation of the machine part to which the sensor is assigned.

Figure 3:
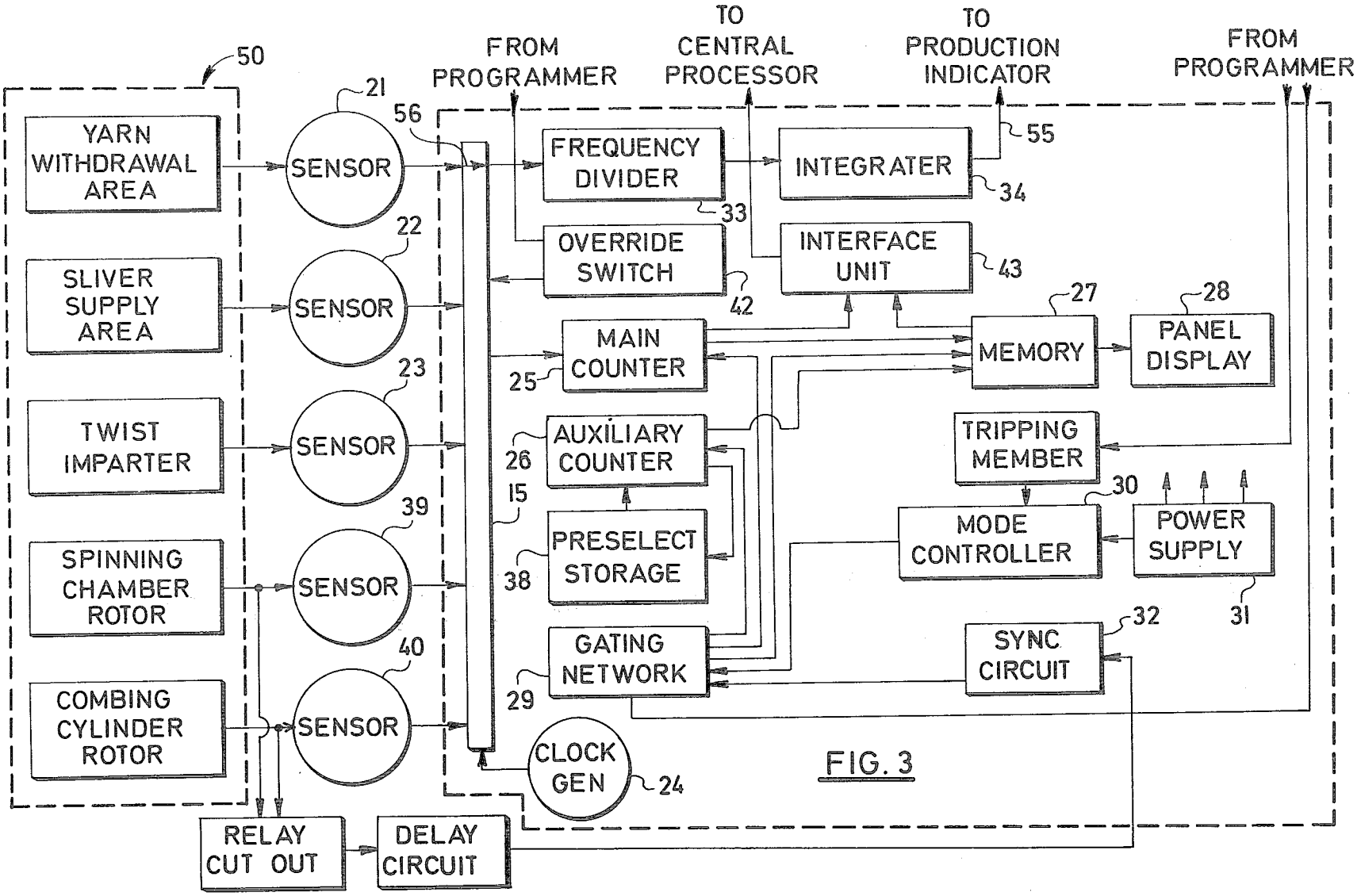
FIG. 3 is a block diagram of one embodiment of digital monitoring apparatus associated with the machine of FIG. 1.

A plurality of such sensors are designated in FIG. 3 at 21, 22, 23, 39 and 40. As indicated, the sensor 21 is associated with the strand withdrawal area of the machine 50; the sensor 22 is associated with the sliver supply area of the motor; the sensor 23 is associated with the twist-imparting portion of the machine; the sensor 39 is associated with the drive shaft of the spinning chamber; and the sensor 40 is associated with the drive shaft of the combing out cylinder.

The outputs of the illustrated sensors are coupled to individual inputs of a multi-tap sequential switch 15, such switch having a pair of outputs individually coupled to count inputs of a main counter 25 and an auxiliary counter 26. Under normal conditions, the switch 15 may be operated at a regular rate by a clockpulse generator 24, thereby sequentially routing the pulse sequence outputs of the sensors to the counters 25, 26. Alternatively, and especially when ratios of one or more of the quantities measured by the sensors are to be derived, the clock-pulse generator 24 may be overriden by means of a switching unit 42, which permits pulses from one of the sensors (e.g., the withdrawal speed sensor 21) to be routed into the auxiliary counter 26 for a time determined by a selection section 38, as indicated below.

when the clockpulse generator 24 is operating, the number of pulses counted by the main counter 25 when one of the associated sensors 21 – 23 and 39 – 40 are coupled thereto in the associated repitition interval of the generator 24 may be outpulsed in parallel form with the use of conventional gating network 29. The gating network may in turn be regulated by a mode controller 30, which is operated via a tripping member 44 by a local or remote program (not shown) which may be stored in the central processor to which the monitored data from the machine 50 may be transmitted.

In particular, the gating network 29 is adapted to outpulse the accumulated count in the main and/or auxiliary binary counters 25, 26 to a memory 27, whose content may be continuously monitored on a panel indicator 28 associated with a locally mounted control panel 1 (FIG. 1) on the machine 50. The outputs of the main counter 25 and the memory 43 may also be selectively outpulsed, under the control of the gating network 29, to an interface stage 43 for application to a data transmission line 55 that terminates in the central processor.

During the normal routing of the sensor outputs to the main counter 25 via the switch 15, digital quantities representing, respectively, the yarn withdrawal speed, the sliver supply speed, the speed of the twist-imparting member, the spinning chamber rotor speed, and the combing out cylinder rotor speed may be sequentially transmitted to the central processor for utilization in machine regulation in an optimum manner. When a ratio such as the quotient of the instantaneous yarn withdrawal speed to the corresponding sliver supply speed is to be measured, the sliver supply speed sensor 22 is first coupled via switch 15 to the auxiliary counter 26 for a predetermined time set by the generator 24, after which the counter is overriden and the count output of the auxiliary counter is temporarily stored in the storage unit 38. The unit 38 is coupled to an enabling input of the counter 26, whereby such counter is next enabled by the unit 38 for a period proportional to the content of the circuit 38 and thereby to the measured speed of sliver supply. During such latter period, the yarn withdrawal speed sensor 21 is coupled via switch 15 to the count input of the auxiliary counter 26, so that the next-occurring parallel output of the counter 26 will represent the desired ratio.

It will be understood that the output of the auxiliary counter 26 may under such circumstances be coupled to the memory 27 and the interface unit 43 by the action of the gating network 29, in the same manner as the outpulsing of the contents of the main counter 25.

Advantageously, a permanent connection 56 is included in the switch 15 whereby the yarn withdrawal speed, as measured by the sensor 21, is continuously routed through the switch 15 to the input of a frequency divider 33, whose output is applied to an integrater 34 to produce an indication of the total output quantity of yarn from the machine. The output of the integrater 34 may be suitably quantized into shift production, i.e., the quantity of yarn produced during any given operating period of the machine 50. The resulting production indicator may be located in the central processor, or locally on the panel 1 on the machine 50, or both.

Figure 4:
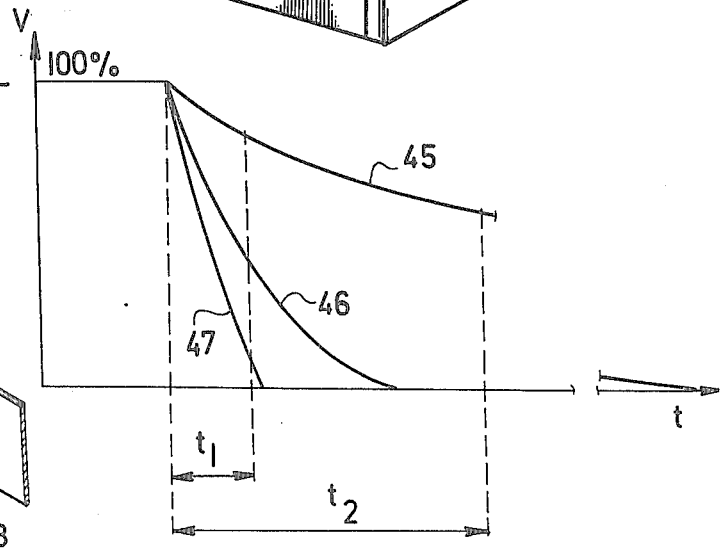
FIG. 4 is a graph illustrating the diminution of speed of certain portions of the spinning machine of FIG. 1 after the removal of power therefrom, together with an indication of the various monitoring instants at which such portions of the machine are associated with the monitoring apparatus of FIG. 3.

In order to measure the braking efficiency of certain portions of the machine, i.e., the drive shaft for the spinning chamber and/or the combing out cylinder, facilities may be provided in the machine 50 for periodically disabling such drive shafts and for monitoring the associated sensors 39 and 40 at predetermined instants after operating power is removed from the associated drive shafts. Such scheme is illustrated in FIG. 3, whereby the combing out cylinder and the spinning chamber are shown as associated with relay-type cut out means 57 associated with their respective drive shafts. Auxiliary contacts (not shown) on the respective cut out relays are coupled via conventional circuitry to a delay network 58, whose output is coupled via a sync circuit 32 to the gating network 39. The resultant sequence is illustrated in FIG. 4, whereby curves 45, 46 and 47 respectively indicated the speed decrease of the drive shaft associated with the spinning chamber, the combing out cylinder and the distributing rollers when the cut out relays 57 are actuated. Thus, at an instant $t_1$ after cut out determined by the delay network 58, the sync circuit 32 is operated to outpulse the then-occurring content of the main counter 25 to the memory 27 and to the interface circuit 48, such an instant being timed to occur when an associated one of the sensors (e.g.,) the sensor 39 or 40) is coupled via the switch 15 to the main counter 25. The delay network 58 is further adapted to cause, via the circuits 32 and 29, the outpulsing of the counter 25 at an instant $t_2$ (FIG. 4). The digitally sensed speeds of the associated drive shafts at the instants $t_1$ and $t_2$ can then be compared, as by the ratio measurements indicated above, as an indication of the braking efficiency of the respective drive shaft.

In the foregoing, an illustrative arrangement of the invention has been described. Many variations and modifications will now occur to those skilled in the art. For example, it will be evident that local switching of the mode controller 30 and the override switching 42, together with any other desired switching pattern for the gating network 29 and the multi-tap switch 15, can be associated with the local control panel 1 of the unit as well as with the central processor. It is accordingly desired that the scope of the appended claims not be limited to the specific disclosure herein contained.

What is claimed is:

1. Apparatus for digitally mointoring selected operating parameters of an open-end spinning machine, the machine including a rotary combing cylinder for separating slivers supplied thereto into fibers, means for feeding slivers into the combing cylinder, a rotary spinning chamber coupled to the output of the combing cylinder for spinning separated fibers into yarn, and means for withdrawing spun fibers from the spinning chamber, the apparatus comprising, in combination, first detection means coupled to the spun fiber withdrawing means for generating a first sequence of pulses at a rate proportional to the rate of withdrawal of the spun fibers, second detection means coupled to the sliver-introducing means for generating a second sequence of pulses at a rate proportional to the rate of introduction of the slivers, multi-tap sequentially operable switching means having at least first and second inputs and first and second outputs, a main binary counter, an auxiliary binary counter, a memory, means for selectively coupling the output of the main and auxiliary counters to the memory, means for coupling the first output of the switching means to the count input of the main counter, means for coupling the second output of the switching means to the count input of the auxiliary counter, means for coupling the output of the first detection means to the first input of the switching means, means for coupling the output of the second detection means to the second input of the switching means, and means for operating the switching means.

2. Apparatus as defined in claim 1, further comprising selection means associated with the auxiliary counter for enabling the auxiliary counter for a period proportional to the content of the selection means.

3. Apparatus as defined in claim 2, in which the selection means comprises means for temporarily storing a previous output of the auxiliary counter.

4. Apparatus as defined in claim 1, further comprising interface means coupled to the output of the memory and of the main counter for outpulsing the contents of a selected one of the memory and the main counter.

5. Apparatus as defined in claim 1, in which the spinning unit further comprises means for imparting a twist to the spun yarn, in which the switching means comprises a third input, and in which the apparatus further comprises, in combination, third detection means coupled to the twist-imparting means for generating a third sequence of pulses at a rate proportional to the rate of operation of the imparting means, and means for coupling the output of the third detection means to the third input of the switching means.

6. Apparatus as defined in claim 1, in which each detection means comprises, in combination, a roller dynamically coupled to the associated one of the withdrawing and supplying means, a disc carried coaxial with the roller and having a plurality of circumferentially spaced magnetic indicia thereon, and an electromagnetic transducer disposed in magnetic coupling relation with the periphery of the disc for producing the associated sequence of pulses in synchronism with the movement of the indicia past the transducer.

7. Apparatus as defined in claim 1, in which the spinning unit further comprises cutout switches individually associated with the spinning chamber and the combing cylinder, respectively, in which the switching means further comprises third and fourth inputs, and in which the apparatus further comprises, in combination, third detection means coupled to the spinning chamber for generating a third sequence of pulses indicative of the instantaneous rotational speed of the spinning chamber, fourth detection means coupled to the combing cylinder for generating a fourth sequence of pulses indicative of the rotational speed of the combing cylinder, means for individually coupling the outputs of the third and fourth detection means to the third and fourth inputs of the switching means, and timing means coupled to the outputs of the respective cutout switches for enabling the main counter at a predetermined time following the operation of the respective cutout means.

8. Apparatus as defined in claim 1, in which the switching means further comprises a third output and means for permanently connecting one of the inputs of the switching means to the third output thereof, and in which the apparatus further comprises, in combination, a frequency divider, means for coupling the third output of the switching means to the input of the frequency divider, and means for integrating the output of the frequency divider.

9. Apparatus as defined in claim 1, in which the operating means comprises a clock pulse generator.

10. Apparatus as defined in claim 9, in which the operating means further comprises means for overriding the clock pulse generator.

* * * * *